US009455524B2

(12) United States Patent
Madden

(10) Patent No.: US 9,455,524 B2
(45) **Date of Patent: *Sep. 27, 2016**

(54) SELF-SUPPORTED JACKET SEAL FOR HIGH VOLTAGE CABLE ACCESSORIES

(71) Applicant: Richards Manufacturing Company Sales, Inc., Irvington, NJ (US)

(72) Inventor: Jeffrey L. Madden, Bernardsville, NJ (US)

(73) Assignee: Richards Manufacturing Company Slaes, Inc., Irvington, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/754,373

(22) Filed: Jun. 29, 2015

(65) Prior Publication Data

US 2016/0056569 A1 Feb. 25, 2016

Related U.S. Application Data

(63) Continuation of application No. 13/843,960, filed on Mar. 15, 2013, now Pat. No. 9,071,004.

(51) Int. Cl.
*H01R 13/53* (2006.01)
*H01R 13/52* (2006.01)

(52) U.S. Cl.
CPC ..... *H01R 13/5205* (2013.01)

(58) Field of Classification Search
CPC ..... H01R 13/53; H01R 101/00
USPC ..... 439/181, 921, 184, 183, 185, 205
See application file for complete search history.

(56) References Cited

U.S. PATENT DOCUMENTS

| | | | | |
|---|---|---|---|---|
| 5,525,076 | A | 6/1996 | Down | |
| 5,696,351 | A | 12/1997 | Benn et al. | |
| 8,282,410 | B2 | 10/2012 | Siebens et al. | |
| 8,328,569 | B2 | 12/2012 | Roscizewski et al. | |
| 8,368,405 | B2 | 2/2013 | Siebens | |
| 8,541,684 | B2 | 9/2013 | Meyer et al. | |
| 8,597,040 | B2 | 12/2013 | Siebens et al. | |
| 9,071,004 | B2 * | 6/2015 | Madden | H01R 13/5205 |
| 2010/0029115 | A1 * | 2/2010 | Coldren | F02M 51/005 439/279 |
| 2012/0004621 | A1 * | 1/2012 | Shaw | A61M 5/3234 604/221 |

* cited by examiner

*Primary Examiner* — Phuongchi T Nguyen
(74) *Attorney, Agent, or Firm* — Bakos & Kritzer

(57) ABSTRACT

A self-supported jacket seal designed for a cable connector so that after a cable is inserted into the cable connector, the integrated jacket seal protects any exposed portion of the cable without requiring any additional installation steps. The self-supported feature is provided by a plurality of rigid ridges positioned on the outer surface of the jacket seal. The ridges strengthen the construction of the component so that the jacket seal substantially maintains its shape when a cable is slidably inserted therewithin. Because the seal does not buckle when installed, it does not require any additional installation steps as found in other similar inventions known in the art.

17 Claims, 6 Drawing Sheets

200

SELF-SUPPORTED JACKET SEAL FOR HIGH VOLTAGE CABLE ACCESSORIES

CROSS-REFERENCE TO RELATED APPLICATIONS

This application is a continuation of U.S. patent application Ser. No. 13/843,960, filed Mar. 15, 2013, now U.S. Pat. No. 9,071,004, issued Jun. 30, 2015, and the foregoing application is herein incorporated by reference in its entirety.

FIELD OF THE INVENTION

The present invention relates generally to cable and connector adapters used in the field of power distribution. More particularly, the invention relates to cable and connector adapters with an integrated jacket seal that does not buckle when a prepared cable is slidably inserted therewithin.

BACKGROUND OF THE INVENTION

Electrical distribution networks are critical for the delivery of electricity to consumers and businesses from the generation and transmission systems. Such a network can include power lines, substations, transformers, and meters that are interconnected by thousands of miles of cables. Existing cable adapters that are used to fit "(one) size fits all" splice housings to different cables are well known in the art. Generally, in order to attach a cable to an electrical joint or splice it is necessary to peel back the protective layers of the cable, so that the conductor portion of the cable can be attached to the cable connector. The protective layers consist of an outer jacket, an insulation shield system (typically semi conductive and metallic), insulation, strand shield, and finally the conductor. The stripping procedure exposes the cable metallic shielding, which provides pathways for return power in the system.

Although a portion of the exposed cable is within the cable adapter, another portion of the cable is external to the connection. In most instances, this external portion of the cable can be exposed to water, dirt, and other elements that can cause the cable to degrade in quality. The exposed cable metallic shielding is particularly susceptible to moisture, due to oxidization and corrosion. Over extended periods of time the buildup of oxidation results in the degradation or total loss of the proper return circuit for the load current. As a result, electricity can be interrupted to residential and commercial areas until the cable is either repaired or replaced. Furthermore, if water is allowed to enter under the cable jacket material it will be in closer proximity to the cable primary insulation causing a more rapid degradation and eventual failure of the insulation and loss of power.

Due to the critical need for the continual operation of electrical distribution networks, such problems have not been entirely ignored in the industry. Cable jacket sleeves provide protection for the exposed cable portion between the end of the accessory (such as a cable adapter, insulating plug, etc.) and the cable jacket sleeve. Typically, cable jacket sealing sleeves are hollow cylindrical shapes and come in a pre-molded slide on, heat shrink, or cold shrinkable variety.

Pre-molded slide-on jacket sleeves require the splicer to pre-install the sleeve on the cable prior to installation of the accessory. Once the accessory is attached to the cable, a water-resilient resin or gum-like mastic and/or electrical tape is placed over the exposed portion of the cable. The jacket sleeve is then pulled over the mastic and/or electrical tape, exposed cable, and a portion of the accessory, thereby providing protection for the exposed portion of the prepared cable. Small tabs were placed on the side of slide-on jacket sleeve to assist splicers with pulling such sleeves up and down.

Heat shrink jacket sleeves are placed over the exposed portion of the cables as described above. The splicer subsequently applies heat to the connecter to shrink the sleeve around the exposed portion of the cable to create a tighter fit.

Cold shrinkable jacket sleeves are expanded and placed onto a removable core. Once the splicer has placed the cold shrinkable sleeve over the accessory and prepared cable, the core is removed and the sleeve shrinks to its original size. Due to various power cable varieties such as Jacketed Concentric Neutral (JCN), Drain wire shielded, and Tape shielded, a splicer must choose the applicable cold shrinkable jacket, thereby adding additional complexity to the process of attaching a cable to a cable adapter.

A disadvantage of using a heat or cold shrink seal is that they are designed to be permanently installed. Therefore, the process of removing a heat or cold shrink seal involves destroying the seal, generally by cutting it from the cable. As a result, the splicer may inadvertently damage the cable by cutting too deep.

An inherent problem with the multi-step process of installing pre-molded slide-on, heat shrinkable, and cold shrinkable jacket sleeves is that when an electrical distribution network is interrupted, the ability to quickly troubleshoot and repair the cause of the interruption is hampered by the complexities of the existing systems, particularly in situations where multiple sections of a cable are simultaneously damaged or compromised. Furthermore, multi-step procedures combined with the pressure for results, since electricity is interrupted to homes and businesses until the network is repaired, can lead to the improper field repair performance which could deviate from applicable field standards. As a result, an improperly repaired cable can repeatedly fail, resulting in an unreliable electrical distribution network to homes and businesses in the area.

The combination of a jacket sleeve integrated with an accessory was created to reduce the time of attaching cables to an accessory. In this known combination, the jacket sleeve is rolled over a portion of the accessory. In the field, once the splicer inserts the prepared cable into the accessory the integrated jacket sleeve is pulled over the remaining exposed wire. An example of an accessory with an integrated jacket sleeve can be found in Hughes et al. U.S. Pat. No. 7,883,356 entitled "Jacket Sleeve with Grippable Tabs for a Cable Connector." In this particular example, tabs are introduced in the assembly to provide a gripping point for the splicer to pull the jacket sleeve over the exposed cable.

A disadvantage of current elbow adapters with the integrated jacket sleeve is that the coupling with the prepared cable is not complete until the splicer pulls the jacket sleeve over the exposed portion of the prepared cable. This can be difficult in the restricted space in which cables are installed. Even with various improvements over the years in the relevant art, such as the incorporation of tabs as presented in Hughes et al., it still remains difficult for a splicer to properly secure the jacket sleeve over the exposed cable, even after inventions have improved the size of the tabs and various ways to pull the jacket sleeve. The assembly is difficult for a myriad of reasons including the requirement of substantial force to properly form the connection which often results in various components being compromised or damaged and the restricted space such connections are generally performed.

Further, integrated jacket sleeves are composed of flexible materials that provide little to no mechanical support. Therefore, for power cables that span large distances, external mechanical supports are required to resist mechanical stress from bending the power cable where it connects with the cable adapter with integrated jacket sleeve.

Therefore, there is a need in the art for a self-supported jacket seal that does not buckle when an exposed cable is inserted into the jacket seal. Furthermore, there is a need for a jacket seal which can be utilized in restricted space whereby the seal is complete after inserting the cable, instead of requiring the user to pull the jacket seal over an exposed portion of the wire to complete the seal.

In addition, there is a need for a self-supported jacket seal that can be removed, without utilizing a cutting tool that can damage the cable. As a result, the self-support jacket seal can be reused.

Further, there is a need for a self-supported jacket seal that provides mechanical support.

SUMMARY OF THE INVENTION

One embodiment according to the present invention involves a self-supported jacket seal that can be utilized in the restricted environments common in cable installations which will not buckle when a cable is inserted therein. In this preferred embodiment, the self-supported jacket seal is designed in the form so that after a cable is inserted into the accessory, the integrated jacket seal protects any exposed portion of the cable without any additional steps. This results in improved field installation over the current operations known and utilized in the existing art.

In one embodiment, the self-supported feature is provided by a plurality of ridges positioned on the outer surface of the jacket seal. The ridges can be comprised of a rigid material, designed to strengthen the construction of the component so that the jacket seal substantially maintains its shape when a cable is slidably inserted. In a further embodiment of the present invention, an end of the jacket seal is flared to allow inserting a cable therein in a sliding movement.

BRIEF DESCRIPTION OF THE DRAWINGS

A further understanding of the present invention and the objectives other than those set forth above can be obtained by reference to the various implementations set forth in the illustrations of the accompanying figures. Although the illustrated implementations illustrate certain aspects of the present invention, the apparatus and method of use of the invention, in general, together with further objectives and advantages thereof, may be more easily understood by reference to the drawings, examples, and the following description. The examples and figures are not intended to limit the scope of this invention, which is set forth with particularity in the claims as appended or as subsequently amended, but merely to clarify and exemplify the invention. The detailed description makes reference to the accompanying figures wherein:

DETAILED DESCRIPTION OF THE EMBODIMENTS

A detailed description of the various embodiments of the present invention is disclosed herein. However, techniques of manufacture and resulting structures in accordance with the present invention may be embodied in a wide variety of forms and modes, some of which may be quite different from those in the disclosed embodiments. Consequently, the specific structural details disclosed herein are merely representative, yet in that regard, they are deemed to represent suitable implementations for purposes of disclosure and to provide a basis for the claims herein, which define the scope of the present invention. Well known methods, procedures, and substances for both carrying out the objectives of the present invention and illustrating the preferred embodiment are incorporated herein but have not been described in detail as not to unnecessarily obscure novel aspects of the present invention.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, electronic or otherwise, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the Detailed Description of the Embodiments using the singular or plural number may also include the plural or singular number respectively. The word "or," in reference to a list of two or more items, covers all of the following interpretations of the word: any of the items in the list, all of the items in the list, and any combination of the items in the list.

Figure 1:
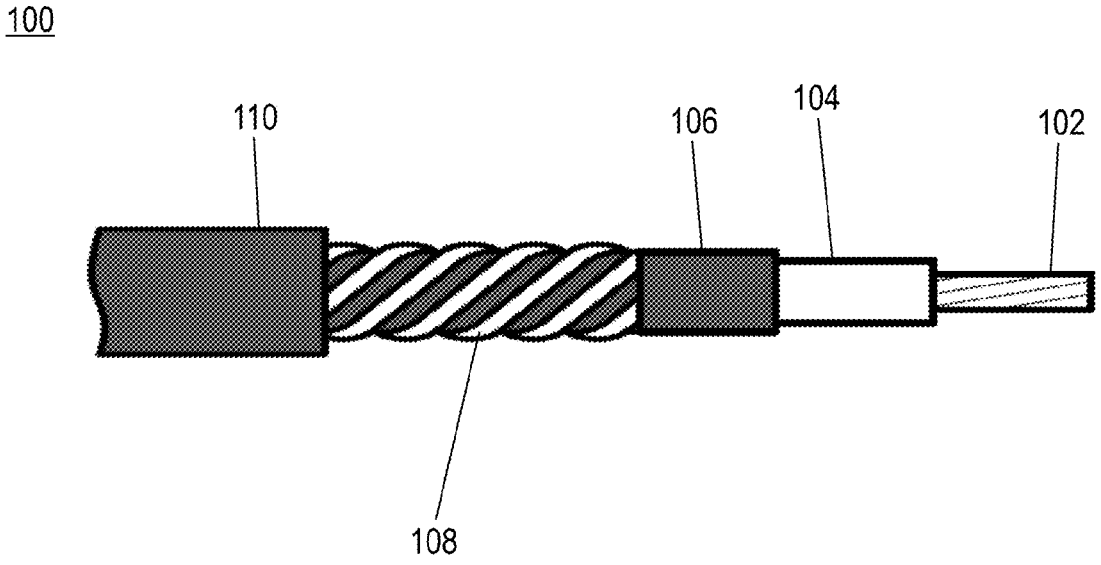
FIG. 1 depicts a prepared cable end designed to carry electrical currents common in the art.

Referring initially to FIG. 1, shown is a typical prepared cable end 100. As illustrated, prepared cable end 100 comprises an outer jacket 110, neutral wires 108, extruded shield 106, cable insulation 104, and cable conductor 102. Typically, a prepared cable 100 is created by removing the outer cable jacket 110 and folding back the neutral wires 108 from the extruded shield 106. Extruded shield 106 is also removed to partially expose cable insulation 104. Furthermore, cable insulation 104 is removed to expose cable conductor 102. Although a jacketed concentric neutral cable is depicted in FIG. 1, the present invention is not limited to such a cable. One skilled in the art would understand that other cable constructions such as jacketed drain wire, lead jacketed, copper tape shielded, and the like may be utilized with the component of the present invention without departing from the spirit of the invention as disclosed.

Figure 2:
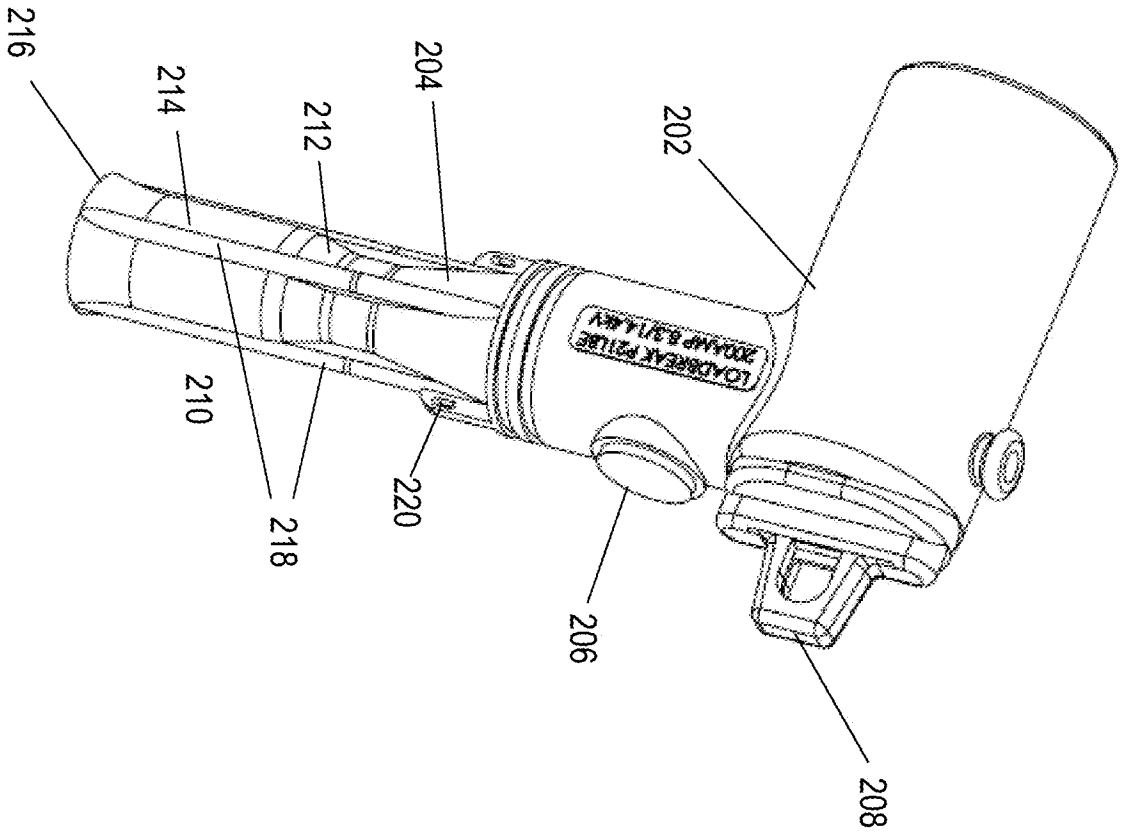
FIG. 2 is a perspective view of a loadbreak connector having an integrated jacket seal in accordance with an exemplary embodiment of the present invention.

Turning next to FIG. 2, shown is a perspective view of a jacket seal sleeve integrated with a loadbreak connector 200 in accordance with an exemplary embodiment of the present invention. A loadbreak connector 200 includes an insulated conductor receiving portion 204 which can receive a high voltage conductor or prepared cable therein, and a substantially right-angled probe retainer 202. The loadbreak connector 200 further includes grounding eye 220 that can be molded or affixed along the exterior surface of loadbreak connector 200. Grounding eye 220 is capable of receiving and being connected to an external ground in order to ensure that the outer surface of loadbreak connector 200 remains at ground potential. While the loadbreak connector 200 is illustrated as having an elbow-like design, the loadbreak connector 200 can be of other types and configurations known to one skilled in the art.

The loadbreak connector 200 can further include a test point 206. It is known to one skilled in the art to use a high-impedance voltage sensing device at test point 206 to determine the circuit condition of loadbreak connector 200. Test point 206 can include a cap (not shown) that is capable of being snapped onto and cover test point 206. Therefore, access to test point 206 is prevented from elements external to loadbreak connector 200.

The loadbreak connector 200 can further include a pulling eye 208. The pulling eye 208 is positioned substantially in line with the longitudinal-axis of probe retainer 202. The pulling eye 208 provides a location to connect a hotstick or other device for engaging or disengaging elbow connector 200. In one exemplary embodiment, pulling eye 208 is manufactured of stainless steel. One skilled in the art will readily recognize that other metallic and non-metallic elements can be employed in place of stainless steel. The external surface of pulling eye 208 is typically surrounded by a shield layer consisting of semi-conductive EPDM or like material commonly utilized in the art.

Jacket seal 210 includes a jacket seal body 214 and neck 212 which are integrally formed. In one example, jacket seal 210 and conductor receiving portion 204 are integrally formed. In the present example, jacket seal 210 has a substantially hollow cylindrical shape with an inner diameter that tapers to form a compression fit. Those of ordinary skill in the art will recognize that the present invention is not limited to the use of a compression fitting connection within loadbreak connector 200 for coupling a prepared cable 100 (not shown) inserted into receiving portion 216, and that other types of connection fittings, such as a slide on interference, can be used without departing from the spirit and the scope of the present invention. In the present embodiment, the length of jacket seal 210 is designed to be greater than the length of prepared cable 100, thereby enclosing some of the outer jacket of prepared cable 100.

A plurality of ridges 218 are attached to the outer surface of the conductor receiving portion 204 and jacket seal 210, thereby providing longitudinal support for the structure of jacket seal body 214 when prepared cable 100 (not shown) is inserted into receiving portion 216. In various embodiments, the length of ridge 218 begins at one end of receiving portion 216 and substantially extends to the other end of conductor receiving portion 204. In the present embodiment ridge 218 is composed of a rigid material, while jacket seal body 214 is composed of a pliable material. Thereby jacket seal body 214 can stretch over the exposed cable conductor 102 of prepared cable 100, while ridges 218 provide longitudinal support, so that jacket seal body 214 will substantially maintain its shape during and after prepared cable 100 is inserted into receiving portion 216.

The loadbreak connector 200 also includes a cable receiving portion 216 positioned on one end of jacket seal 210. In various embodiments of the present invention, receiving portion 216 has a substantially cylindrical shape that has an inner diameter dependent on the size of prepared cable 100 that receiving portion 216 is intended to receive. In the present example, the receiving portion 216 is flared, thereby facilitating prepared cable 100 slidably inserting into jacket seal body 214. The cable conductor 102 of prepared cable 100 is slidably inserted into receiving portion 216, until it abuts and is connected to conductor receiving portion 204.

Figure 3:
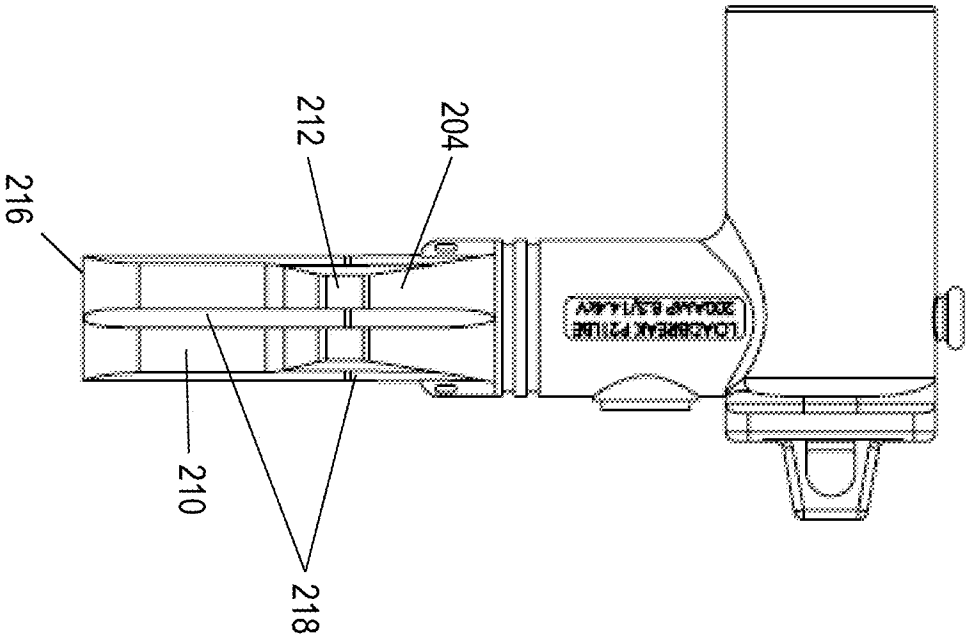
FIG. 3 is a side view of a loadbreak connector having an integrated jacket seal in accordance with an exemplary embodiment of the present invention.

Turning next to FIG. 3, shown is a side view of a loadbreak connector having an integrated jacket seal in accordance with an exemplary embodiment of the present invention depicted in FIG. 2. As shown in the present embodiment of FIG. 3, ridge 218 does not contact the outer surface of jacket seal 210 and insulated conductor receiving portion 204 throughout the length of ridge 218. As a result, less material is required to form ridge 218, and provide longitudinal support for jacket seal body 214 to maintain its shape while inserting prepared cable 100 within receiving portion 216. Alternatively, in another embodiment, ridge 218 can contact the outer surface of jacket seal 210 and insulated conductor receiving portion 204 throughout the length of ridge 218.

Figure 4:
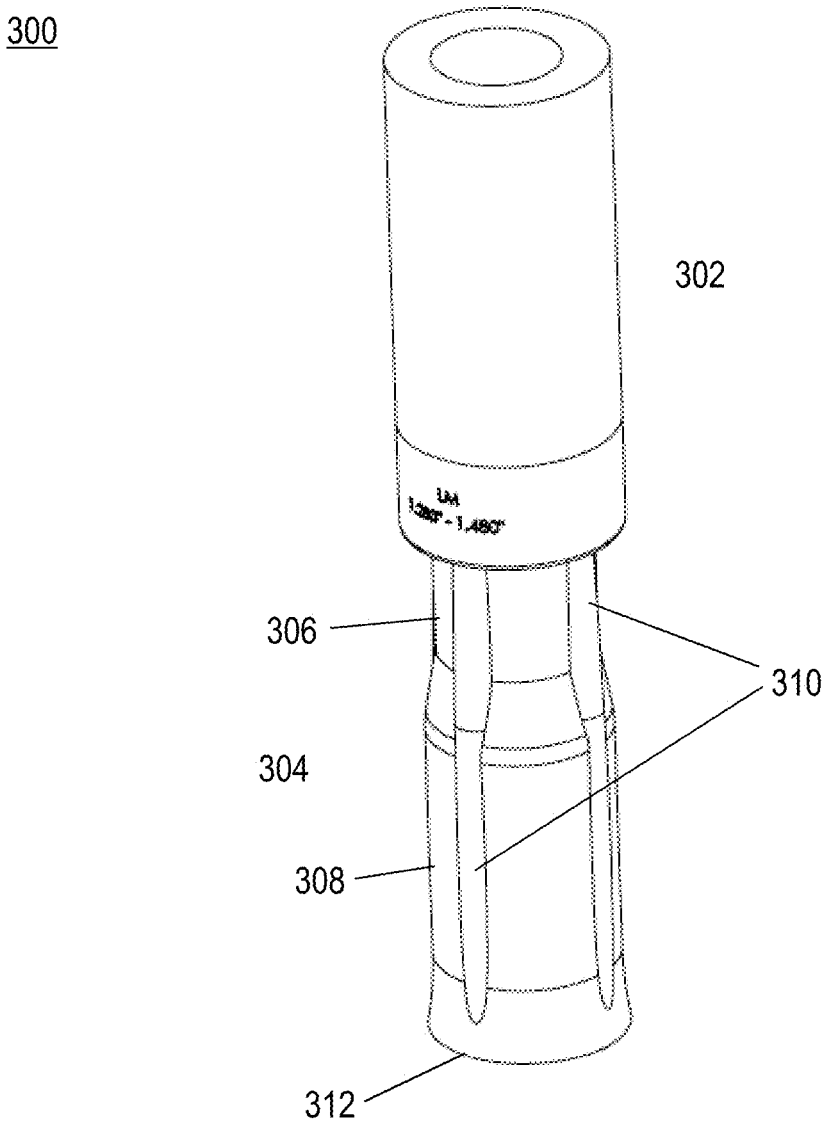
FIG. 4 is a perspective view of a cable adapter having an integrated jacket seal in accordance with an exemplary embodiment of the present invention.

Referring now to FIG. 4, shown is a cable adapter 300, in accordance with an exemplary embodiment of the present invention. The cable adapter 300 includes an integrated insulated conductor receiving portion 302 and jacket seal 304. Both insulated conductor receiving portion 302 and jacket seal 304 are positioned on a primary longitudinal axis of cable adapter 300, whereby insulated conductor receiving portion 302 is located on a first end of cable adapter 300, while jacket seal 304 is located on a second end of cable adapter 300. A receiving portion 312 is located on an end of jacket seal 304 (i.e., at an end opposing the receiving portion 302, which is located on a first end of cable adapter 300). In the present example, insulated conductor receiving end 302 has a substantially hollow cylindrical shape of sufficient design and dimension to accept prepared cable 100 as described in FIG. 1, herein.

As depicted, the jacket seal 304 includes a jacket seal body 308 and neck 306. Jacket seal body 308 and neck 306 can be made of semi-conductive rubber, silicone, EPDM or other suitable materials known to those of ordinary skill in the art. A plurality of ridges 310 are integral with and disposed along the longitudinal axis of the outer surface of jacket seal 304. The introduction of the plurality of ridges 310 from a rigid material, provides longitudinal support allowing the jacket seal body 308 to maintain its shape, as a prepared cable (not shown) is forced and slidably inserted into receiving portion 312.

In one embodiment, the material of ridge 310 is substantially plastic-like. In another embodiment the material of the outer surface of ridge 310 is the same as jacket seal 304 (i.e., semi-conductive rubber, silicone, EPDM or other suitable materials known to those of ordinary skill in the art), thereby saving manufacturing material and processes.

In the present embodiment, the length of ridge 310 is substantially the length of jacket seal 304; however, one of ordinary skill in the art will readily recognize that ridges may be manufactured of any length which allowed for the improved installation accomplished by the present invention. Furthermore, the plurality of ridges 310 can be evenly spaced around the outer surface of jacket seal 304. In an alternative embodiment, the plurality of ridges 310 are not evenly spaced depending on the desired configuration of the component and the environment the component is installed. For example, the spacing of ridges 310 can be altered in the event the confined installation space allows for other components which might interfere with the jacket seal. Although the structure depicted for providing support for jacket seal 304 is a plurality of ridges 310 positioned parallel to one another, it should also be apparent to one skilled in the art that other external support structures can be used. For example, a criss-cross shape can be used to provide longitudinal and latitudinal support for the structure of jacket seal 304.

In the present example, ridges 310 are shaped such that it substantially traces the contour of jacket seal 304. It is well known in the art that the installation of such electrical components requires the use of substantial force to make a complete and strong contact. As a result, a ridge 310 is in contact with jacket seal 304 throughout the length of jacket seal 304, thereby providing longitudinal support, so that jacket seal 304 does not buckle when prepared cable 100 is inserted into receiving portion 312.

The jacket seal 304 of the present invention further includes a receiving portion 312. Prepared cable of the nature described in FIG. 1 of the present disclosure is slidably inserted into cable adapter 300 through receiving portion 312, thereby creating a compression fit when the prepared cable abuts with insulated conductor receiving portion 302. After insertion of prepared cable 100 (not shown) into cable adapter 300 a portion of the cable conductor may protrude from cable adapter 300. In yet another embodiment, jacket seal body 308 can utilize a slide-on interference fit to couple prepared cable 100 (not shown) to a cable adapter 300. In the present embodiment, the length of jacket seal 304 is designed to be greater than the length of prepared cable, thereby enclosing a portion of outer jacket of prepared cable.

Figure 5:
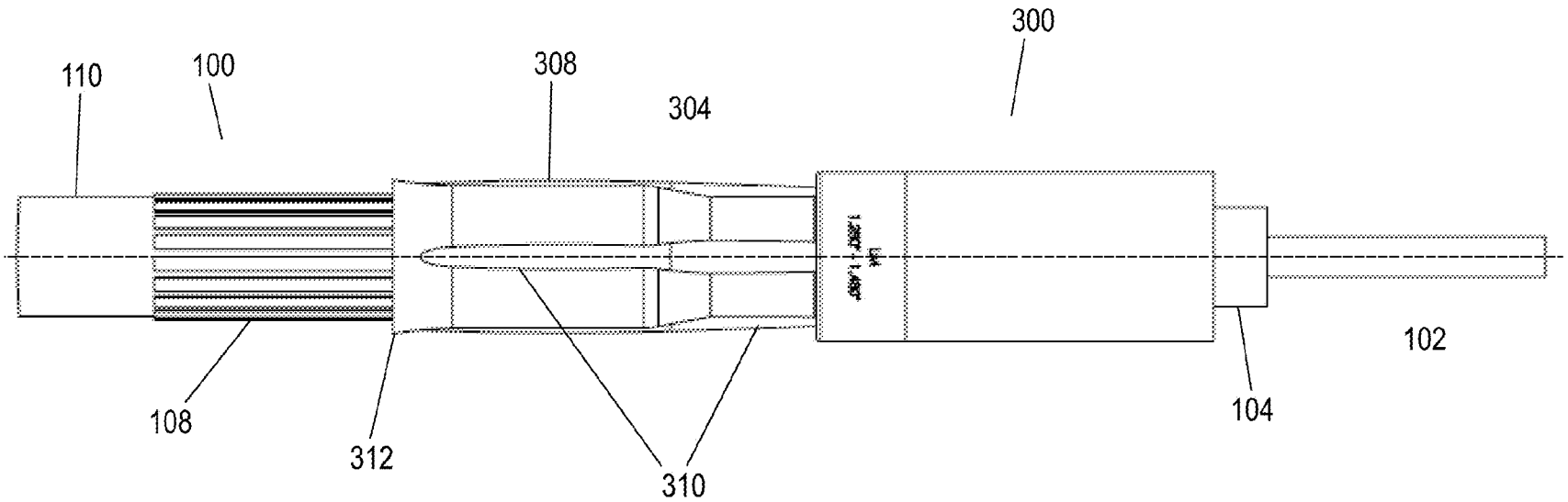
FIG. 5 is a side view of a cable adapter having an integrated jacket seal with a prepared cable positioned therein in accordance with an exemplary embodiment of the present invention.

Referring now to FIG. 5, depicted is a side view of the cable adapter 300 with prepared cable 100 slidably inserted therewithin. As shown, receiving portion 312 is flared to facilitate outer jacket 110 of prepared cable 100 sliding into jacket seal 304. The dimensions of receiving portion 312 is such that it facilitates prepared cable 100, with folded back exposed concentric neutral wires 108, which is slidably inserted therewithin.

Figure 6A:
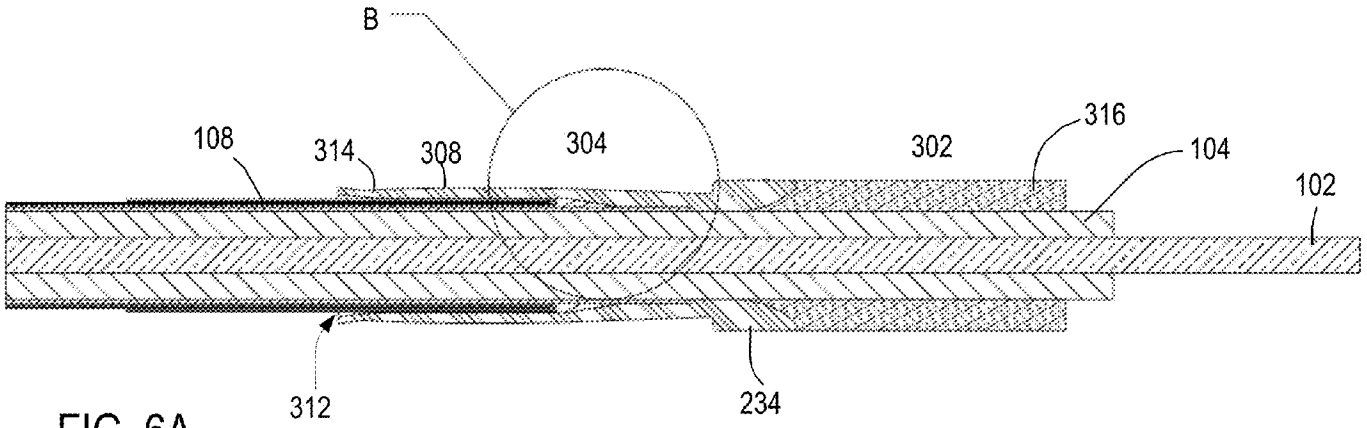
FIG. 6A is a longitudinal cross-sectional view of a cable adapter having an integrated jacket seal with a prepared cable positioned therein in accordance with one exemplary embodiment of the present invention.

Referring now to FIG. 6A, a longitudinal cross-sectional side view of cable adapter 300 with prepared cable 100 slidably inserted therewithin is shown. In this depiction, jacket seal material 314 consists of a semi-conductive pliable material, while insulated conductor receiving portion material 316 is non-conductive and rigid. This allows jacket seal body 308 to expand and stretch over the outer dimensions of prepared cable 100 as prepared cable 100 is forced and slidably inserted into receiving portion 312. It would be apparent to one skilled in the art that jacket seal material 314 and insulated conductor receiving portion material 316 can have the same rigidity, provided that jacket seal material 314 is pliable enough to slidably insert prepared cable 100 into receiving portion 312.

Figure 6B:
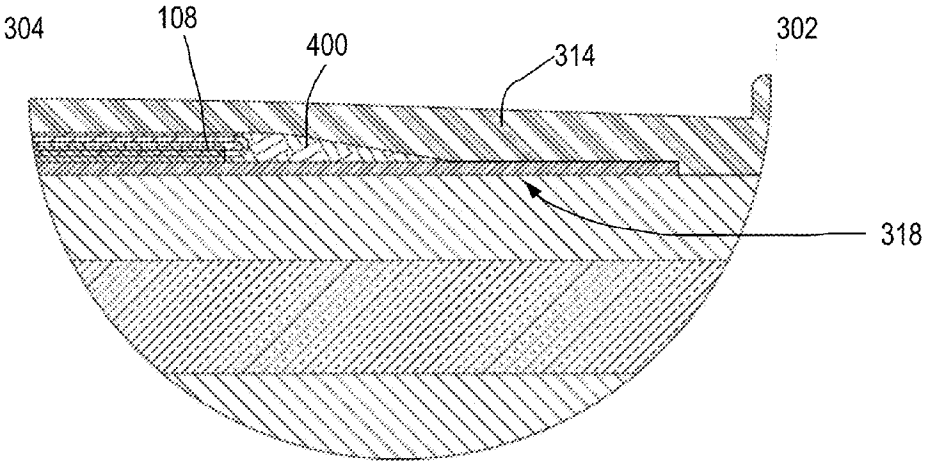
FIG. 6B is an enlarged cross-sectional view of a section of cable adapter having an integrated jacket seal with a prepared cable positioned therein in accordance with one exemplary embodiment of the present invention.

Turning next to FIG. 6B, shown is an expanded detailed view of section B of FIG. 6A. In this figure, sealing mastic 400 is wrapped both underneath and over the top of neutral wires 108, providing a seal to prevent dirt, water, and other external elements from entering the cable adapter 300 or prepared cable 100. Further, the electrical contact between jacket sleeve 304 and insulated conductor receiving portion 302 is made in area 318 when prepared cable (as shown in FIG. 6A) is slidably inserted therewithin.

Jacket seal material 314 and insulated conductor receiving portion material 316 can be molded using techniques known to one skilled in the art. For example, a single molding can be made whereby jacket seal material 314 and insulated conductor receiving portion material 316 are injected into their respective sections. The sections can also be molded separately using known molding techniques and jacket seal 304 can be affixed to the insulated conductor receiving portion 302. In another example, the molded jacket seal 304 can be placed in a second mold, so that insulted conductor receiving portion 302 is over-molded onto jacket seal 304, thereby bonding the insulated conductor receiving portion 302 to the jacket seal 302.

Although the use of the present invention with a load beak adapter and cable adapter have been disclosed in detail it would be obvious to one skilled in the art that the jacket seal can be utilized with other accessories known in the field such as joints, elbows and terminators. Further, a splice can utilize the jacket seal of the present invention by attaching a jacket seal of the present invention to each end of the splice where prepared cables are slidably inserted therewithin.

Thus, there has been summarized and outlined, generally in broad form, a plurality of the most important features of the present invention. While this summary is presented so that the novelty of the present contribution to the related art may be better appreciated, it will further be apparent that additional features of the invention described hereinafter (which will form the subject matter of the claims appended hereto) will further define the scope, novelty, and in certain instances the improvements upon any existing art. The following description provides specific details for a thorough understanding of, and enabling description for, various examples of the technology. One skilled in the art will understand that the technology may be practiced without many of these details and it is to be readily understood that the invention presented herein is not limited in its application to the details of construction and to the arrangements of the components set forth in the following description or illustrated in the various figures integrated and categorized herein. For example, in some instances, well-known structures and functions have not been shown or described in detail to avoid unnecessarily obscuring the description of the examples of the technology. It is intended that the terminology used in the description presented below be interpreted in its broadest reasonable manner, even though it is being used in conjunction with a detailed description of certain examples of the technology. Although certain terms may be emphasized below, any terminology intended to be interpreted in any restricted manner will be overtly and specifically defined as such in this Detailed Description section. In addition, those of ordinary skill in the art will readily recognize that the headings of sections provided in this patent application and the title of this patent application are for convenience only, and are not to be taken as limiting the disclosure in any way. Those skilled in the art will appreciate that the disclosure of the present invention may readily be utilized as a basis for the designing of other similar structures, methods and systems for carrying out the various purposes and objectives of the present invention. Thus, the claims as set forth shall allow for such equivalent constructions insofar as they do not depart from the spirit and scope of the present invention as described herein. While certain aspects of the device are presented below in certain claim forms, the inventor contemplates the various aspects of the system in any number of claim forms. Accordingly, the inventor reserves the right to add additional claims after filing the application to pursue such additional claim forms for other aspects of the system.

I claim:

1. A jacket seal, comprising:

a pliable elastomeric body comprising, a hollow tubular body defining a shape, a first end, a second end, an interior portion, and an outer surface;

wherein a structural support is positioned on the outer surface of the elastomeric body;

wherein the structural support substantially maintains the shape of the elastomeric body when a cable is slidably inserted; and wherein the elastomeric body is coupled to a cable accessory;

wherein the second end is integrally molded to a load-break elbow connector;

wherein the structural support comprises a plurality of ridges positioned on a longitudinal axis of the outer surface;

wherein the plurality of ridges are affixed to the outer surface of the jacket body substantially throughout a longitudinal direction of the outer surface and comprises of a rigid material;

wherein the first end is flared facilitating slidably inserting the cable.

2. The jacket seal of claim 1, wherein the first end is flared.

3. The jacket seal of claim 1, wherein the sleeve is manufactured of EPDM.

4. The jacket seal of claim 1, wherein the structural support comprises a plurality of ridges positioned in a criss-cross shape.

5. The jacket seal of claim 1, wherein the structural support comprises a plurality of ridges positioned on a longitudinal axis of the outer surface.

6. The jacket seal of claim 5, wherein the plurality of ridges are affixed to the outer surface of the jacket body substantially along the longitudinal axis of the outer surface and the plurality of ridges comprise a rigid material.

7. The jacket seal of claim 1, further comprising:

a hollow tubular neck comprising:

a first end, and a second end;

wherein the first end of the tubular neck is connected to the second end of the elastomeric body creating a tubular pathway; and wherein the neck has an inner diameter different from an inner diameter of the tubular body.

8. The jacket seal of claim 7, wherein the neck is integrally molded to the tubular body.

9. A jacket seal, comprising:

a substantially straight pliable elastomeric body comprising:

a hollow tubular body defining a shape, a first end, a second end, an interior portion, and an outer surface;

wherein a substantially rigid structural support is positioned along a longitudinal axis of the outer surface of the elastomeric body; and wherein the structural support substantially maintains the shape of the elastomeric body when a cable is slidably inserted;

wherein the second end is integrally molded to a load-break elbow connector;

wherein the structural support comprises a plurality of ridges positioned on a longitudinal axis of the outer surface;

wherein the plurality of ridges are affixed to the outer surface of the jacket body substantially throughout a longitudinal direction of the outer surface and comprises of a rigid material;

wherein the first end is flared facilitating slidably inserting the cable.

10. The jacket seal of claim 9, wherein the first end is flared.

11. The jacket seal of claim 9, wherein the structural support comprises a plurality of ridges positioned in a criss-cross shape.

12. The jacket seal of claim 9, wherein the structural support comprises a plurality of ridges.

13. The jacket seal of claim 12, wherein the plurality of ridges are affixed to the outer surface of the jacket body substantially throughout the longitudinal axis of the outer surface and the plurality of ridges comprise a rigid material.

14. The jacket seal of claim 9, wherein the elastomeric body is coupled to a cable accessory.

15. The jacket seal of claim 14, wherein the cable accessory is a cable adapter.

16. The jacket seal of claim 9, further comprising:

a hollow tubular neck comprising, a first end, and a second end;

wherein the first end of the tubular neck is connected to the second end of the elastomeric body creating a tubular pathway; and wherein the neck has an inner diameter different from an inner diameter of the tubular body.

17. The jacket seal of claim 16, wherein the neck is integrally molded to the tubular body.

* * * * *